US009320674B2

(12) United States Patent
Fraser

(10) Patent No.: US 9,320,674 B2
(45) Date of Patent: Apr. 26, 2016

(54) INFLATABLE WEARABLE DEEP PRESSURE THERAPY SYSTEMS

(75) Inventor: Lisa Fraser, Surrey (CA)

(73) Assignee: Wearable Therapeutics Inc., Vancouver (CA)

( * ) Notice: Subject to any disclaimer, the term of this patent is extended or adjusted under 35 U.S.C. 154(b) by 712 days.

(21) Appl. No.: 13/349,368

(22) Filed: Jan. 12, 2012

(65) Prior Publication Data

US 2013/0184623 A1 Jul. 18, 2013

(51) Int. Cl.
*A61H 9/00* (2006.01)

(52) U.S. Cl.
CPC ..... *A61H 9/0078* (2013.01); *A61H 2201/0107* (2013.01); *A61H 2201/018* (2013.01); *A61H 2201/165* (2013.01); *A61H 2201/5071* (2013.01); *A61H 2205/02* (2013.01); *A61H 2205/06* (2013.01); *A61H 2205/062* (2013.01); *A61H 2205/081* (2013.01); *A61H 2205/10* (2013.01)

(58) Field of Classification Search
CPC . A61H 9/00; A61H 9/0078; A61H 2205/081; A61H 2205/062; A61H 2205/06; A61H 2201/5071; A61H 2201/165; A61H 2201/108; A61H 2201/0107
USPC ..... 601/148–152; 602/1, 5, 13, 95, 97, 602/101–103; 2/2.15, 69, DIG. 3, DIG. 10; 441/80
See application file for complete search history.

(56) References Cited

U.S. PATENT DOCUMENTS

| | | | | |
|---|---|---|---|---|
| 3,148,391 | A * | 9/1964 | Whitney | 5/422 |
| 5,338,239 | A * | 8/1994 | Cleaveland | 441/106 |
| 5,403,265 | A * | 4/1995 | Berguer et al. | 601/151 |
| 6,315,745 | B1 * | 11/2001 | Kloecker | 602/13 |
| 6,511,501 | B1 * | 1/2003 | Augustine et al. | 607/96 |
| 6,654,967 | B2 | 12/2003 | Haar | |
| 7,347,815 | B2 | 3/2008 | Serbanescu | |
| 7,614,099 | B2 | 11/2009 | Goetz | |
| 7,870,623 | B2 | 1/2011 | Judd | |
| 2005/0187503 | A1 * | 8/2005 | Tordella et al. | 601/151 |
| 2007/0088235 | A1 * | 4/2007 | Tseng | 601/151 |
| 2008/0086064 | A1 | 4/2008 | Rembrand | |
| 2008/0249440 | A1 * | 10/2008 | Avitable et al. | 601/151 |
| 2008/0294075 | A1 | 11/2008 | Nozzarella | |
| 2009/0318773 | A1 | 12/2009 | Jung | |

(Continued)

FOREIGN PATENT DOCUMENTS

| | | | |
|---|---|---|---|
| WO | 2010056323 | A2 | 5/2010 |
| WO | 2012046068 | A1 | 4/2012 |

*Primary Examiner* — Quang D Thanh
(74) *Attorney, Agent, or Firm* — Oyen Wiggs Green & Mutala LLP

(57) ABSTRACT

The present invention relates to a deep pressure therapy system. The system includes an inflatable component and a shell component. The inflatable component can be removably attached to the shell component to form a wearable assembly. The inflatable component is shaped to conform to a portion of a body of an individual, and includes an inflatable bladder having an inlet port and an outlet port for passage of a fluid. The bladder includes a plurality of depressions which are generally evenly-distributed over a portion of the bladder. In some embodiments, the depressions are circular welds. In some embodiments, the depressions are three-dimensional welds. The bladder may additionally include weld strips. The shell component may include one or more stretchable strips which are expandable as safety feature.

19 Claims, 21 Drawing Sheets

(56) References Cited

U.S. PATENT DOCUMENTS

2010/0004575 A1* 1/2010 Vess ..... 601/152
2011/0087143 A1* 4/2011 Bobey et al. ..... 601/152
2013/0085428 A1* 4/2013 Deshpande ..... 601/148

* cited by examiner

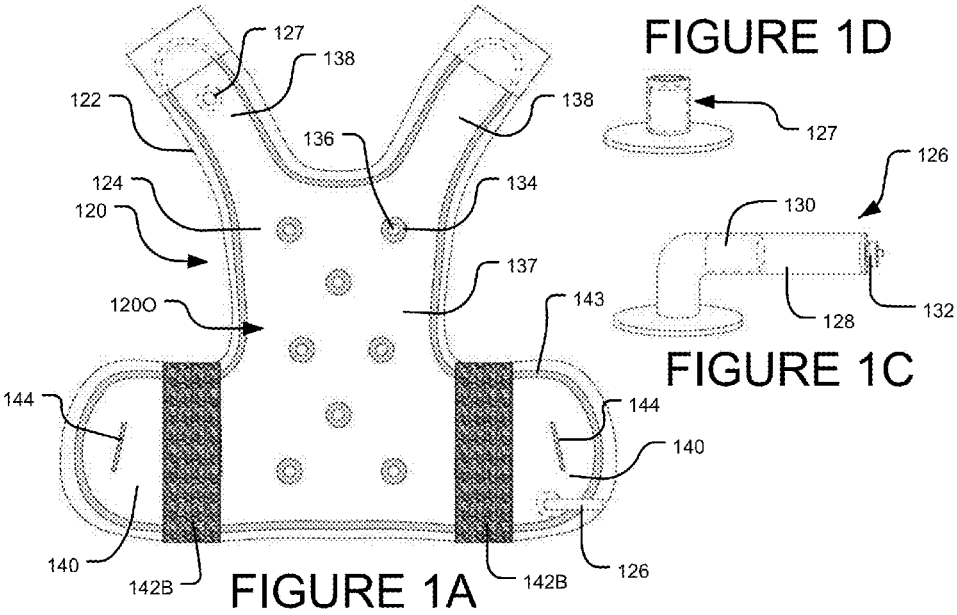
127
138
122
138
136
124
134
120
137
120O
143
144
144
140
140
142B
142B
126
FIGURE 1D
127
126
130
128
132
FIGURE 1C
FIGURE 1A
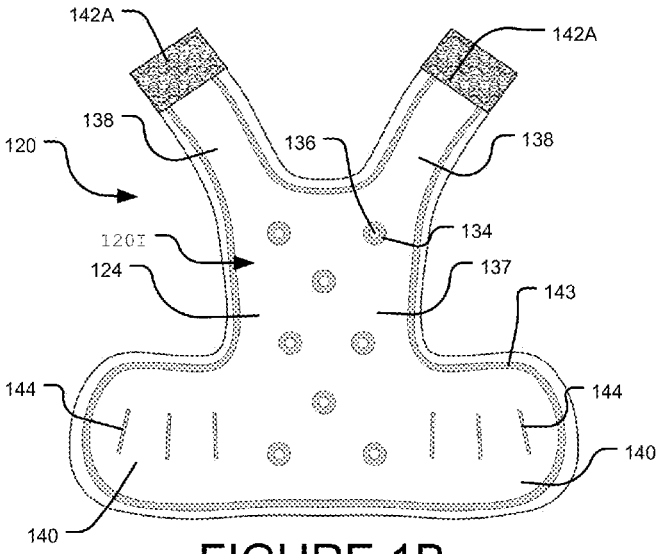
142A
142A
138
136
138
120
134
120I
124
137
143
144
144
140
140
FIGURE 1B

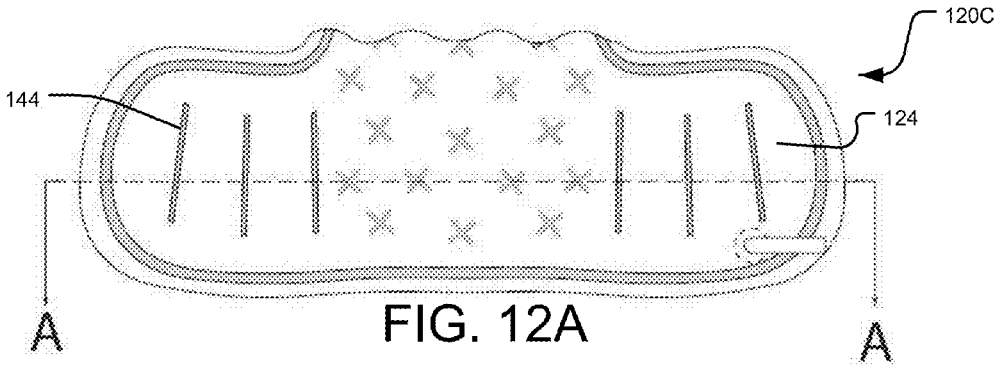
FIG. 12A
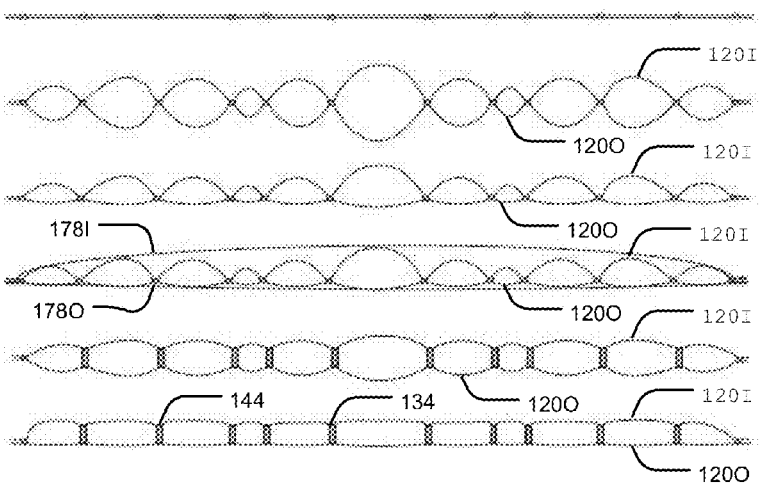
FIG. 12B
FIG. 12C
FIG. 12D
FIG. 12E
FIG. 12F
FIG. 12G
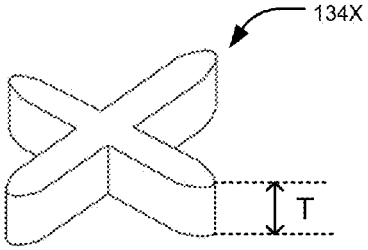
FIG. 12H

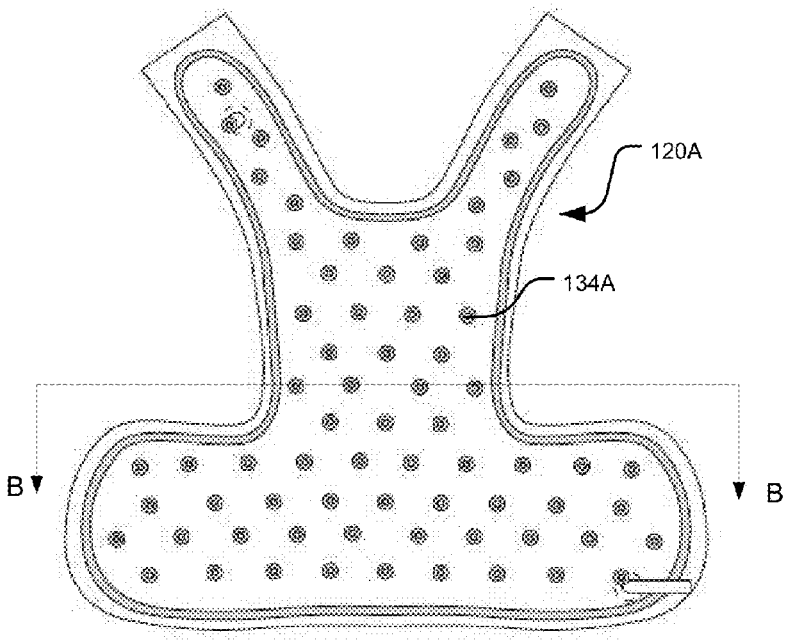
FIG. 13A
FIG. 13B
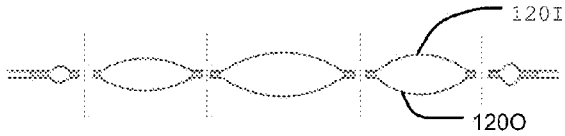
FIG. 13C
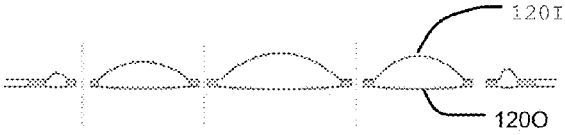
FIG. 13D
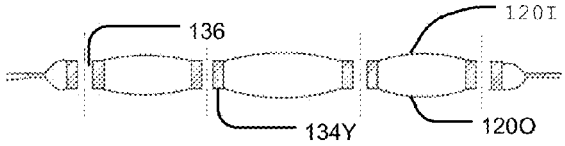
FIG. 13E

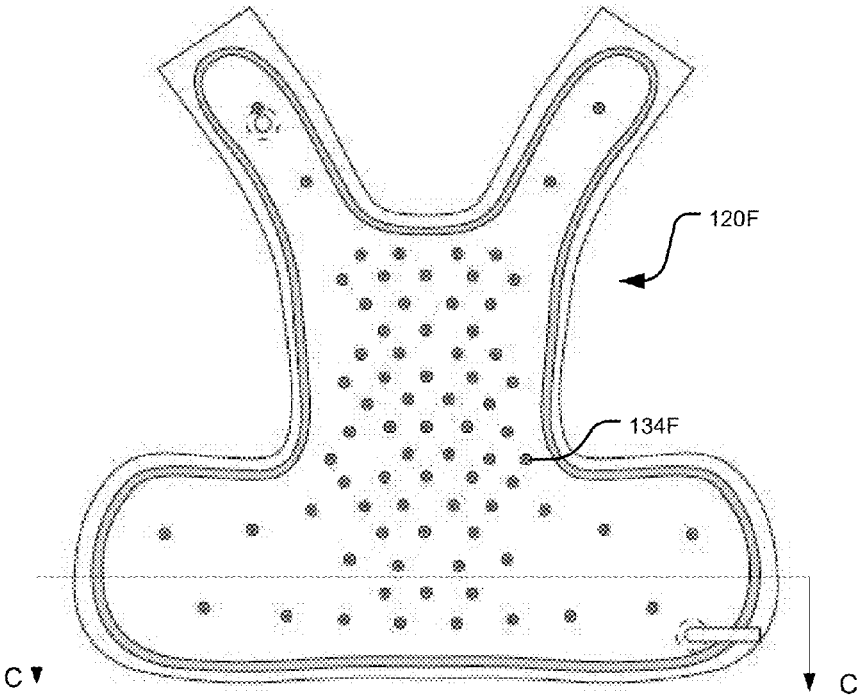
FIG. 14A
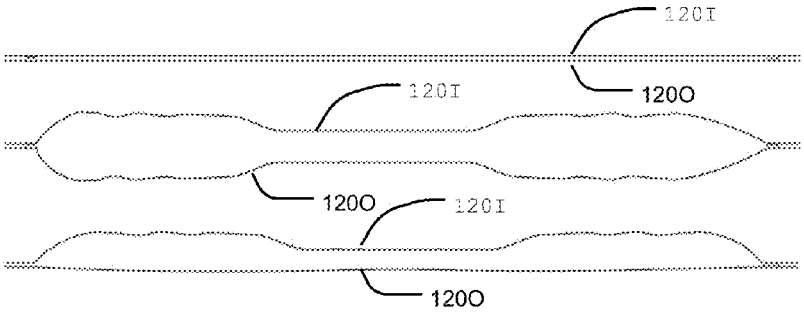
FIG. 14B
FIG. 14C
FIG. 14D

INFLATABLE WEARABLE DEEP PRESSURE THERAPY SYSTEMS

TECHNICAL FIELD

The present invention relates to deep pressure therapy systems and in particular to deep pressure therapy systems in the form of a wearable garment.

BACKGROUND

Deep pressure is the type of surface pressure exerted to a body, for example, by a firm hug, holding, swaddling, or firm petting. Deep pressure applied to many parts of the body has a relaxing and calming effect in adults, children, infants, and some animals. For example, deep pressure has been described to produce a calming effect in children with autism or ADHD (attention deficit hyperactivity disorder). It has been postulated that deep pressure may have beneficial effects for other psychiatric, neurological and/or developmental disorders in adults and children.

Deep pressure devices have been developed to apply deep pressure to a person much like the feeling of a firm hug, swaddling, or firm petting. These devices are often used in hospitals, schools and homes. Some deep pressure devices require large, heavy machines which are not easily portable. In many deep pressure devices, pressure is not easily adjustable, or evenly-distributed, or cannot be documented in a wearable garment in a simple way. These devices also do not provide feedback of the pressure applied, i.e., feedback which can be monitored and then documented. Many devices leave the user of the device in no control over the amount of pressure being applied to their bodies, i.e., the devices are not self-controllable. With many devices, it is difficult to achieve evenly-distributed pressure. Furthermore, many devices lack safety features.

The inventor has determined that there is desire for improved deep pressure therapy systems that provide evenly-distributed pressure, are easy to use, are adjustable in size and/or provide additional safety features.

BRIEF DESCRIPTION OF DRAWINGS

In drawings which show non-limiting embodiments of the invention:

FIGS. 1A and 1B show an inflatable component (outer side and inner side, respectively) of a deep pressure therapy system according to an example embodiment.

FIG. 1C is an enlarged view of an inlet port of the inflatable component of FIG. 1A.

FIG. 1D is an enlarged view of an outlet port of the inflatable component of FIG. 1A.

FIG. 12A shows a portion of an example inflatable component.

FIGS. 12B to 12G show various possible cross-sectional views of the FIG. 12A inflatable component, wherein the cross-sectional views are intentionally straightened for illustrative purposes.

FIG. 12H shows a possible three-dimensional weld that may be used in the FIG. 12A inflatable component.

FIG. 13A shows an example inflatable component.

FIGS. 13B to 13E show various cross-sectional views of the FIG. 13A inflatable component.

FIG. 14A shows an example inflatable component.

FIGS. 14B to 14D show various cross-sectional views of the FIG. 14A inflatable component.

DETAILED DESCRIPTION

Figure 2A:
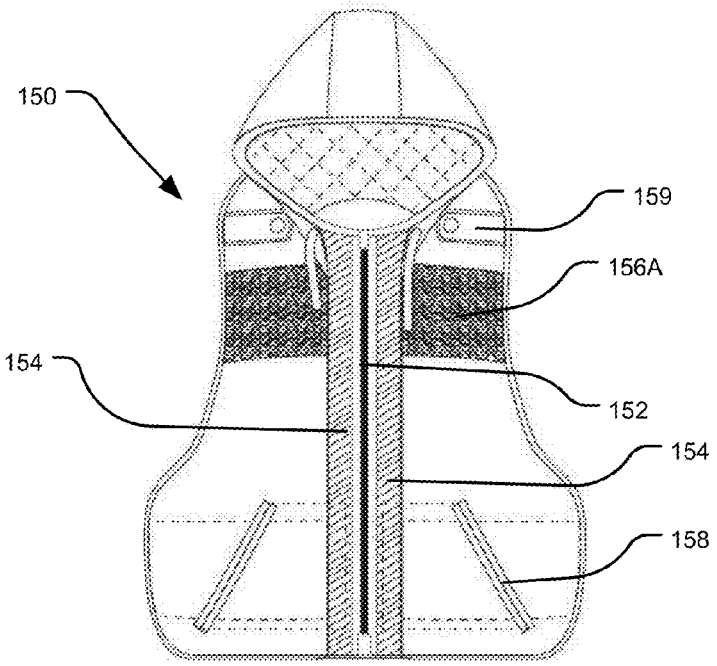
FIGS. 2A and 2B are front and rear view of a shell component of a deep pressure therapy system according to an example embodiment.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

One aspect of the invention relates to a deep pressure therapy system. The deep pressure therapy system of the present invention may include a plurality of components which in combination may form a wearable assembly. A number of example embodiments of the deep pressure therapy system according to the present invention are described below.

FIG. 1A is a view of an inflatable component 120 of a deep pressure therapy system 100 according to an example embodiment of the invention. In FIG. 1A, inflatable component 120 is in an extended configuration, showing the side that is facing away from the body of the wearer (i.e., the outer side 120O of inflatable component 120). FIG. 1B shows the side of inflatable component 120 that is facing toward the body of the wearer (i.e., the inner side 120I of inflatable component 120).

As shown, inflatable component 120 comprises a bladder 124. To make inflatable component 120, two pieces of suitable fabric are radio frequency (r.f.) welded together around the outside of the cut-out shape to create bladder 124. The two pieces of fabrics may be coated with a polymer material (e.g., plastic). Inflatable component 120 can also be made by other methods such as gluing, ultrasonic welding, etc. Inflatable component 120 comprises outer edges 122 which are fabric on the outside of the weld line 143. Edges 122 are where fasteners (e.g., hook-and-loop fasteners) can be sewn on or attached to inflatable component 120. In some embodiments, bladder 124 may be less stretchable on the outer side 120O, and more stretchable on the inner side 120I, so that when bladder 124 is inflated, bladder 124 will expand preferentially inwardly towards the body. To create the preferential effect of bladder 124 expanding inwards, inflatable component 120 may be made by welding a stretchy piece of fabric with a non-stretch piece of fabric. Alternatively, a stretchy and a non-stretch piece of fabric can be fastened on either side of bladder 124.

Bladder 124 comprises an inlet port 126 which enables a person to fill bladder 124 with a fluid using a suitable pump. The fluid may be a liquid or gaseous fluid. The gaseous fluid may be air, nitrogen, or an inert gas. FIG. 1C is an enlarged view of an example inlet port 126. In the FIG. 1C embodiment, inlet port 126 comprises an L-shaped flange portion 128, a pressure relief valve 130, and a connector portion 132. The bottom part of L-shaped flange portion 128 may be radio frequency welded to bladder 124. Pressure relief valve 130 functions as a safety feature to let fluid out when pressure in bladder 124 exceeds a certain level. In some embodiments, inlet port 126 may also comprise an internal check valve so that fluid may only flow in a single direction. Bladder 24 also comprises an outlet port 127 which enables fluid in bladder 124 to flow out. FIG. 1D is an enlarged view of an example outlet port 127. The bottom part of outlet port 127 may be radio frequency welded to bladder 124. Outlet port 127 may be a manual dump valve. It should be noted that various types of manual and dump valve may be used instead of the particular valve shown in FIG. 1D. The locations of inlet port 126 and outlet port 127 may vary, although it is preferable that they are located in easy-to-access locations for safety reasons. In some embodiments, the inlet port and outlet port may be combined in a single port having a common flange and a common fluid passageway. In some embodiments, pressure relief valve can also be placed in outlet port or in its own separate port.

To achieve even distribution of pressure in bladder 124, bladder 124 comprises a plurality of localized depressions. In FIGS. 1A and 1B, these localized depressions are circular welds 134. These circular welds 134 are generally evenly distributed over a substantial portion of bladder 124. Circular welds 134 create localized depressions in bladder 124 and prevents bladder 124 from ballooning out. This is advantageous as it allows bladder 124 to apply evenly-distributed pressure to the body of the wearer. Bladder 124 should be constructed not to exceed a certain thickness (e.g., less than 5 cm, or less than 3 cm, or less than 2 cm) preventing it from becoming bulky and cumbersome.

In the illustrated embodiment, the centers of the welded circles 134 are punched out to create holes 136. These holes 136 provide increased breathability and air ventilation to inflatable component 120 to provide the wearer with increased comfort.

In the illustrated embodiment, inflatable component 120 has a central portion 137, two extended shoulder portions 138 and two extended waist portions 140. The shape of inflatable component 120 is designed such that pressure is applied to the back, sides, and shoulder regions of the body, but not directly on the chest and stomach of the body for safety purposes. Hook-and-loop fasteners 142A and 142B (collectively 142) are provided on shoulder portions 138 and waist portions 140 which allow inflatable component 120 to be fastened to a shell component 150 (shown in FIGS. 2A, 2B, 3B, 3C, 3D) to form a wearable assembly. Shell component 150 and inflatable component 120 work together to function and provide pressure. The hook-and-loop fasteners 142 are typically arranged in the form of one or more patches or strips. Alternatively or additionally, other types of fasteners, such as webbing, strings, snaps, etc, could be used. The use of hook-and-loop fasteners 142 allows inflatable component 120 to be easily engaged with shell component 150 to form a wearable assembly and also both the length and/or width of the assembly to be adjustable. This allows deep pressure therapy system 100 to be used on a child who is growing, or on a number of different individuals who have different heights or sizes.

In the FIGS. 1A and 1B embodiment, bladder 124 is a single chamber bladder. It should be recognized that a bladder having multiple chambers (of either connected or separated chambers) could also be used. As shown in FIGS. 1A and 1B, a radio frequency weld line 143 runs the entire contour of bladder 124. Weld line 143 can create an air-tight seal. Bladder 124 also comprises radio frequency welded strips (e.g., welded strips 144 as shown in FIGS. 1A and 1B). Welded strips 144 may be located on either shoulder portions 138 or waist portions 140 or both. Welded strips 144 may serve two purposes. One is to prevent bladder 124 from ballooning out and to enable even distribution of pressure. The other is to allow bladder 124 to bend at desired locations (e.g., around the shoulder and/or waist regions) and to allow bladder 124 to wrap around a person more easily. This is schematically shown in FIGS. 12I, 12J, 12K, 12L.

Figure 2B:
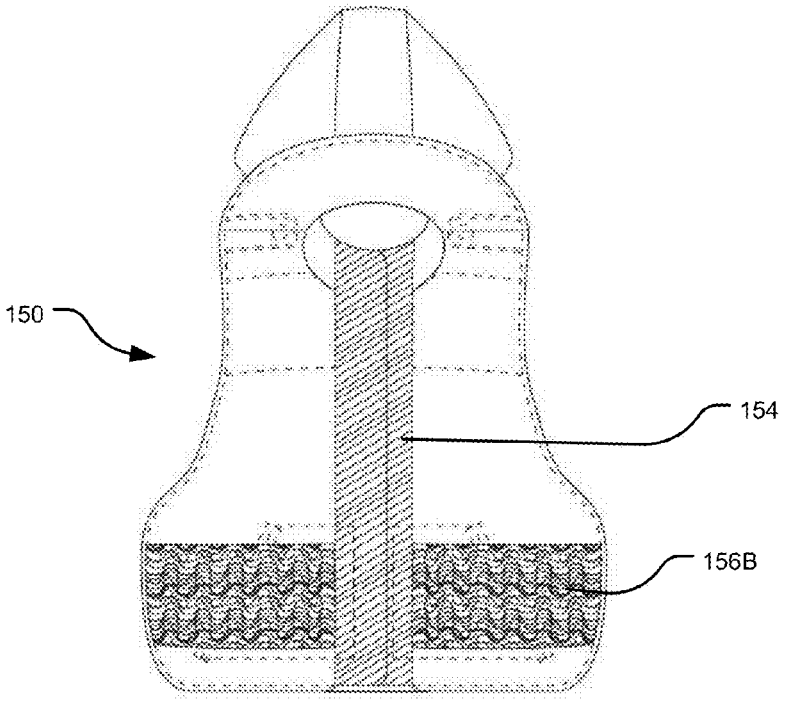
Figure 3A:
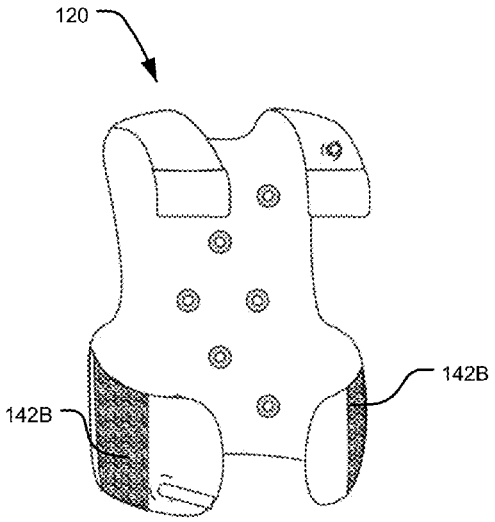
FIGS. 3A to 3D show how the inflatable component and the shell component of FIGS. 1A to 2B may be assembled to form a wearable assembly.
Figure 3B:
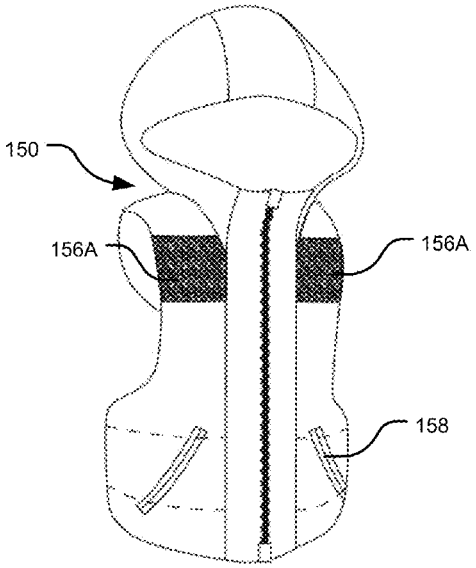
Figure 3C:
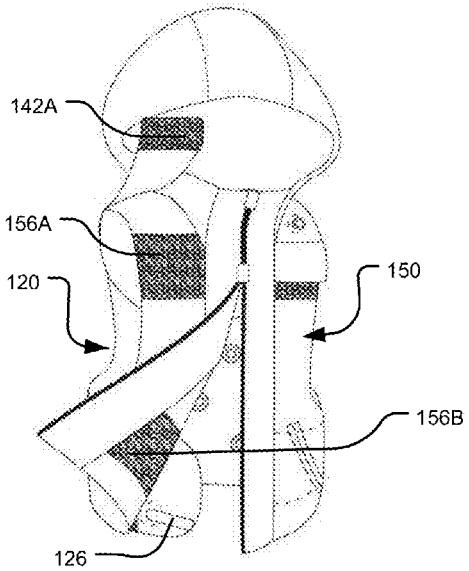
Figure 3D:
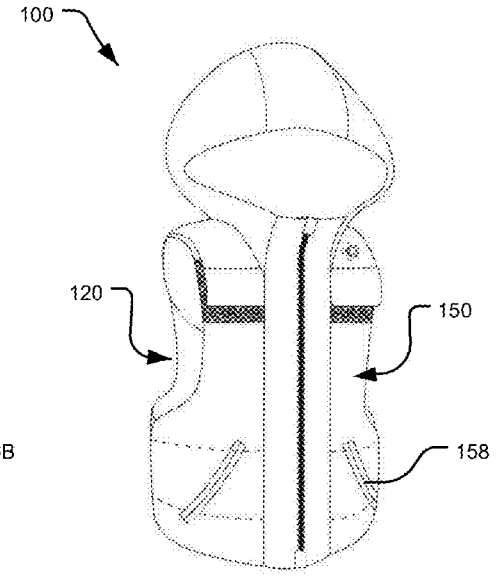

The deep pressure system 100 may comprise a shell component 150. FIGS. 2A and 2B are front and rear view of an example shell component 150. FIGS. 3A to 3D show how inflatable component 120 may be attached to shell component 150 to form an assembly. As shown in FIGS. 2A and 2B, shell component 150 may be in the form of a vest having a hood. The hood may block out light or other distractions to provide more calming and comfort to the wearer. However, this particular configuration for shell component 150 is not mandatory, and shell component 150 may take the form of any other suitable garment or shape. The use of shell component 150 in combination with inflatable component 120 allows the formation of a wearable assembly that places minimal pressure on the stomach and chest and also allows the adjustability in length and width so the assembly fits the user properly to provide pressure when inflatable component 120 is inflated. Shell component 150 comprises zippers 152 so that shell component 150 can be conveniently and easily zipped up, put on and removed from a person.

For safety purposes, the entire assembly can be easily and quickly taken off of the user's body by a front enclosure (e.g., a zipper), or by ripping off the hook-and-loop fasteners to detach the inflatable component from the body. These safety mechanisms are in addition to the pressure relief valve and the outlet port/dump valve that quickly expels air from the bladder.

Zipper 152 may be a double-slider type zipper so that the bottom part of shell component 150 can slide up to for easier access to inlet port 126 of inflatable component 120. It should be noted that instead of zippers 152, other fastening means such as hook-and-loop fasteners, holes and buttons, snaps, straps, strings may also be used. Shell component 150 comprises two stretchable strips 154 adjacent zippers 152. Stretchable strips 154 may be elastic, Lycra™ or Spandex™, or other 2-way or 4-way stretch fabric. The two stretchable strips 154 extend vertically down parallel to zipper 152. When viewed from the rear side (FIG. 2B), stretchable strips 154 flap over zipper 152 to cover zipper 152 for comfort purposes. It is possible that shell component 150 may comprise additional stretchable strips (not shown) located on other parts of shell component 150. When shell component 150 is zipped up, stretchable strips 154 allows shell component 150 to expand when the bladder is inflated and thereby reduce the amount of pressure on the chest and stomach of a person. Therefore, stretchable strips 154 are an important safety feature of the deep pressure therapy system 100.

Shell component 150 comprises hook-and loop fasteners 156A and 156B (collectively 156) which allow inflatable component 120 to be attached to shell component 150 via the engagement of fasteners 142A with 156A and 142B with 156B (see FIGS. 3A to 3D). Shell component 150 may comprise one or more pockets 158 which may optionally have attachable textured fabrics attached inside pockets 158 for tactile stimulation to provide a sense of calming to the wearer. Shell component 150 may also comprise one or more epaulette flaps 159 which may be used to hold inflatable component 120 in place when inflatable component 120 is attached to shell component 150.

The deep pressure therapy system 100 may comprise a pump for inflating bladder 124. Many different types of pumps may be used for this purpose. The pump may be a manual pump (e.g., hand or foot pump) or an electric pump (e.g., battery-operated electric pump) or a combination thereof. The pump may also act as a vacuum to deflate the inflatable component. The deep pressure therapy system 100 may comprise a pressure gauge for reading the pressure of bladder 124. The gauge may be an analog pressure gauge, a digital pressure gauge, or some other suitable pressure gauges. In some embodiments, the gauge may be used to read the amount of pressure against the body via a sensor or sensors.

Figure 4A:
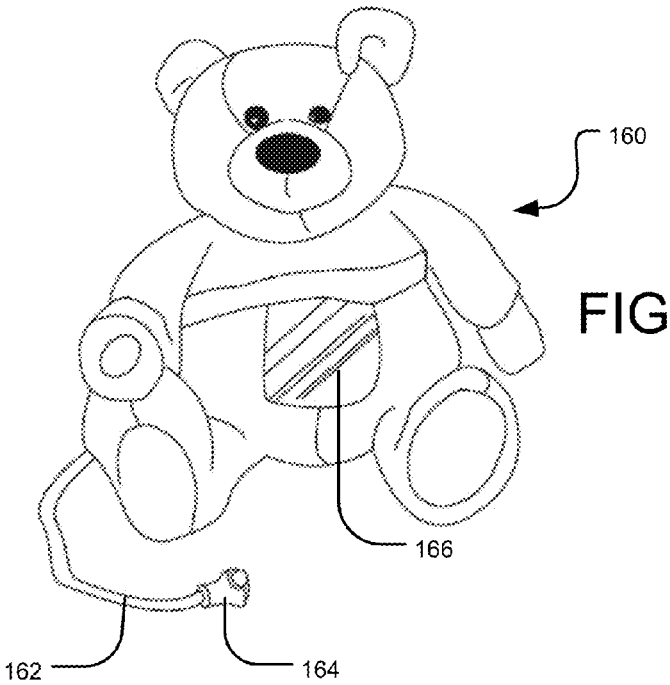
FIG. 4A shows a pump and gauge combination in the form of a teddy bear.
Figure 4B:
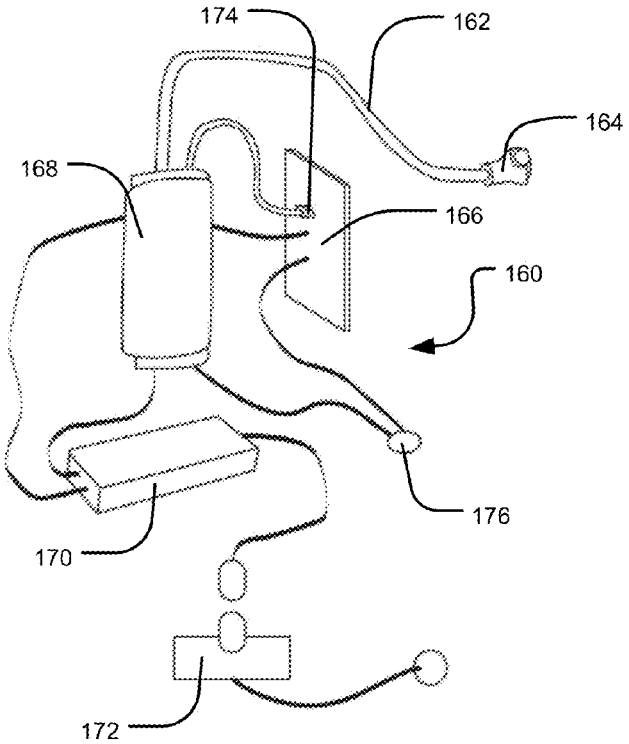
FIG. 4B shows the internal components of the pump and gauge combination of FIG. 4A.

FIGS. 4A and 4B show an example embodiment of a pump and gauge combination 160 in the form of a teddy bear. As shown in FIG. 4A, the pump and gauge combination 160 comprises a tube 162 extending from a pump hidden inside the teddy bear. The terminal end of tube 162 comprises a connector portion 164 which may be removably connected to connector portion 132 of inlet port 126 of inflatable component 120 to inflate bladder 124. The pump can be inflated away from the body and detached once appropriate pressure is achieved. Other forms of the pump not depicted in the figure can be mounted on the wearable assembly on the body where the pump can give 'waves' or pressure on various pressure settings of inflate/deflate modes. A vibration mode may also be chosen separate of air pressure. In this depiction, electronics etc are away from the body to increase comfort, and reduce weight and bulk of the wearable assembly. A separate detachable pump system also ensures safety to the wearer. A pressure reader 166 is provided on the body of the teddy bear, which provides a reading of the pressure inside of bladder 124. Pressure reader 166 allows a user to monitor how much pressure is being given through feedback. The pressure reading can be used to track progress, to enable pressure mapping on an individual, or to obtain more scientific data on deep pressure therapy in general. With sensors located inside the bladder facing towards the body, a reading of the amount of pressure against the body can also be determined. The internal components of the pump and gauge combination 160 is schematically shown in FIG. 4B. As shown in FIG. 4B, hidden inside the teddy bear is an electric pump 168. Tube 162 extends from electric pump 168 to connector portion 164. Electric pump 168 is powered by and electrically coupled to battery 170. Battery 170 may be a rechargeable battery and may be recharged by electrically connecting to a suitable battery charger 172. Electric pump 168 is coupled through a tube to a pressure sensor 174 located on the backside of pressure reader 166. In operation, electric pump 168 may be selectively turned on or off by pushing a switch button 176.

FIGS. 5A to 6C show a deep pressure therapy system 200 according to another example embodiment of the invention. Comparison of the embodiment of FIGS. 5A to 6C and the embodiment of FIGS. 1A to 3D will reveal that system 100 and system 200 share many common features. Components which are common to systems 100 and 200 bear the same reference numerals (except that the leading number "1" is replaced by the leading number "2") and need not be described further. It should be noted that system 200 may comprise the pump and gauge combination 160 shown in FIGS. 4A and 4B. Alternatively, system 200 may comprise other type of suitable pump and/or gauge.

Figure 5A:
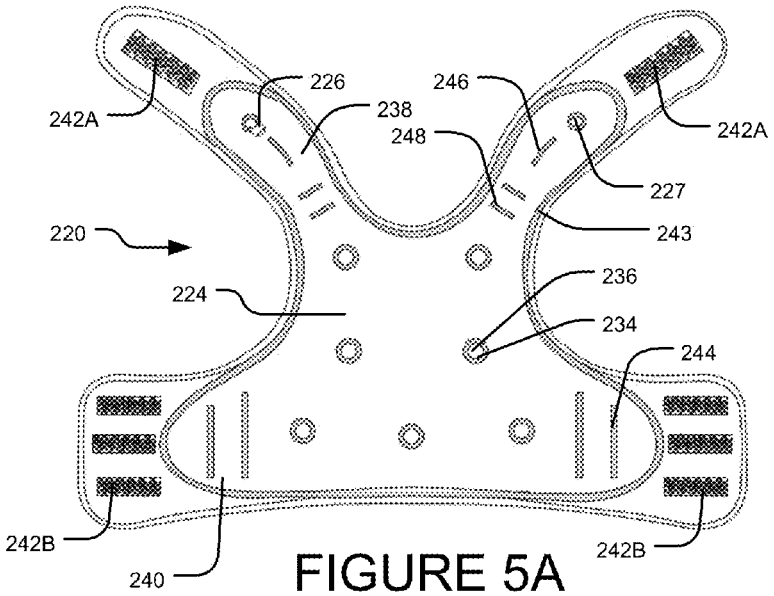
FIGS. 5A to 6C show components of a deep pressure therapy system according to another embodiment.
Figure 5B:
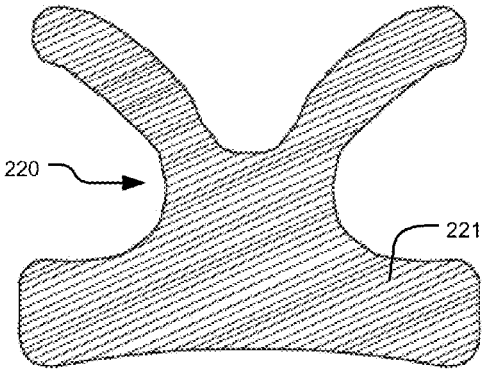
Figure 5C:
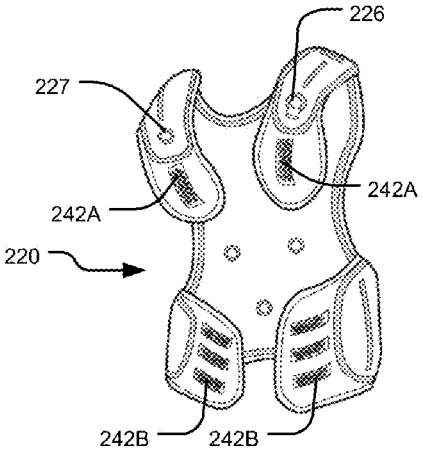

FIG. 5A shows inflatable component 220 of deep pressure therapy system 200 in an extended configuration, showing the side that is facing away from the body of the wearer (i.e., the outer side of inflatable component 220). FIG. 5B shows inflatable component 220 in an extended configuration, showing the side that is facing the body of the wearer (i.e., the inner side of inflatable component 220). As shown in FIG. 5B, inflatable component 220 has a fabric mesh 221 sewn on this inner side around the edges. Fabric mesh 221 adds comfort to inflatable component 220 while still allowing breathability through the punched holes 236. FIG. 5C shows inflatable component 220 in a deployed configuration (i.e., when inflatable component 220 is wrapped around the body of a wearer). As shown in FIGS. 5A and 5C, the location of hook-and-loop fasteners 242A and 242B (collectively 242) differs from the embodiment in FIGS. 1A and 1B. The location of inlet port 226 and outlet port 227 also differ from the embodiment in FIGS. 1A and 1B. Bladder 224 comprises radio frequency welded strips 244, 246, 248 which are located on shoulder portions 238 and waist portions 240 of inflatable component 220 to wrap around the waist and shoulder areas.

Figure 6A:
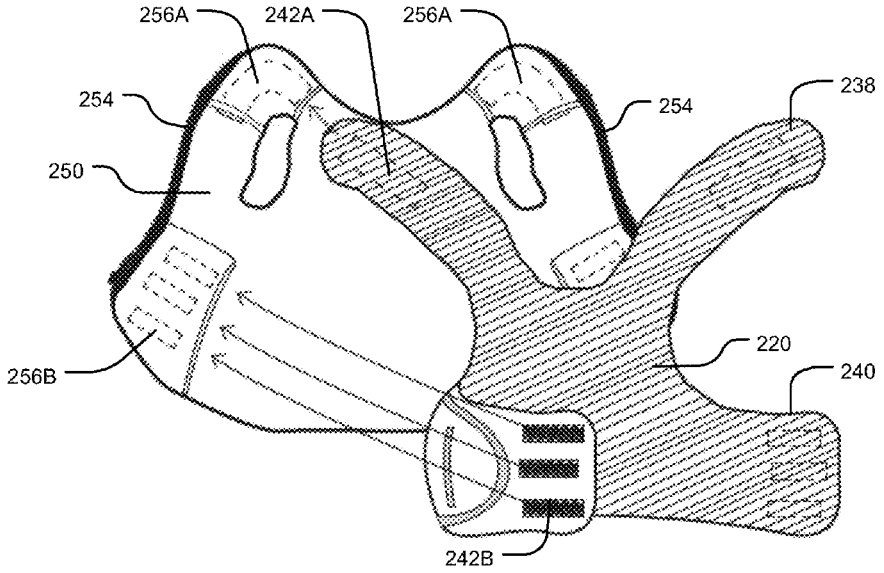
Figure 6B:
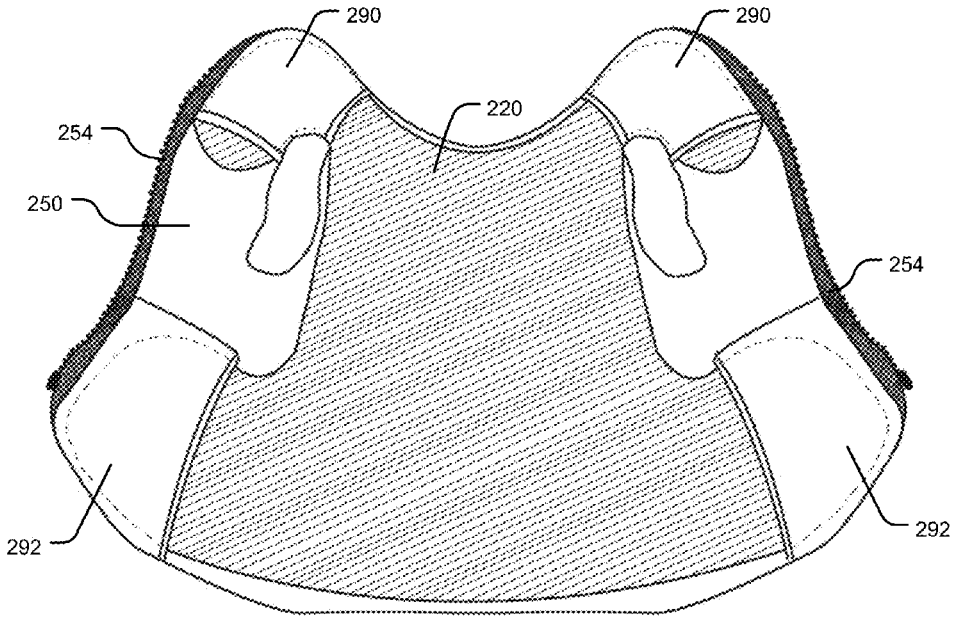
Figure 6C:
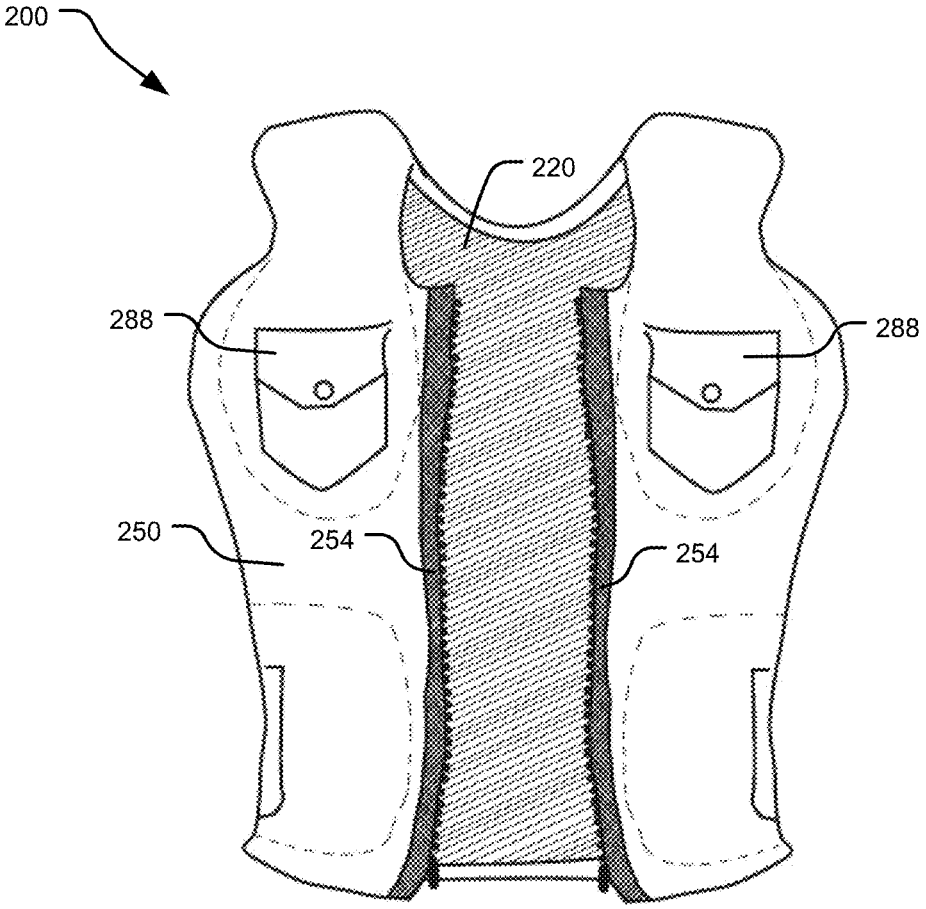
Figure 7A:
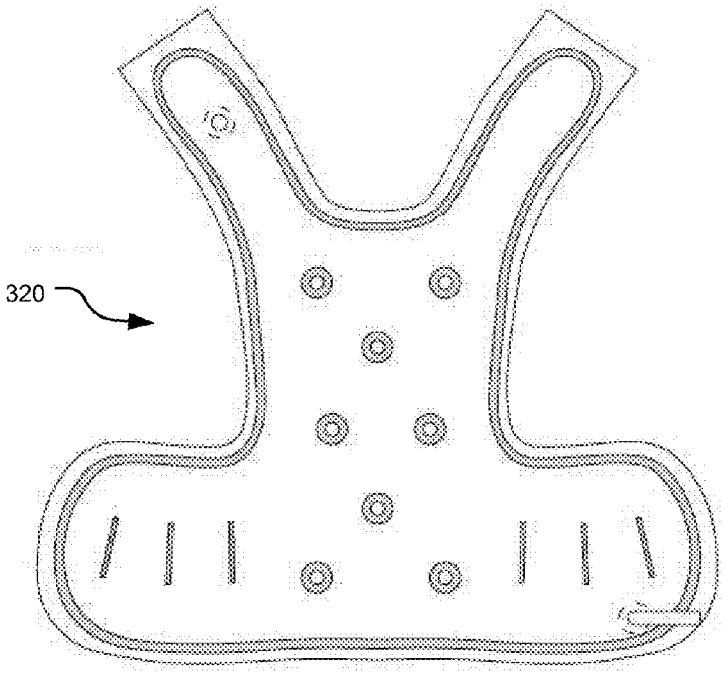
FIGS. 7A to 10C show components of a deep pressure therapy system according to another embodiment.
Figure 7B:
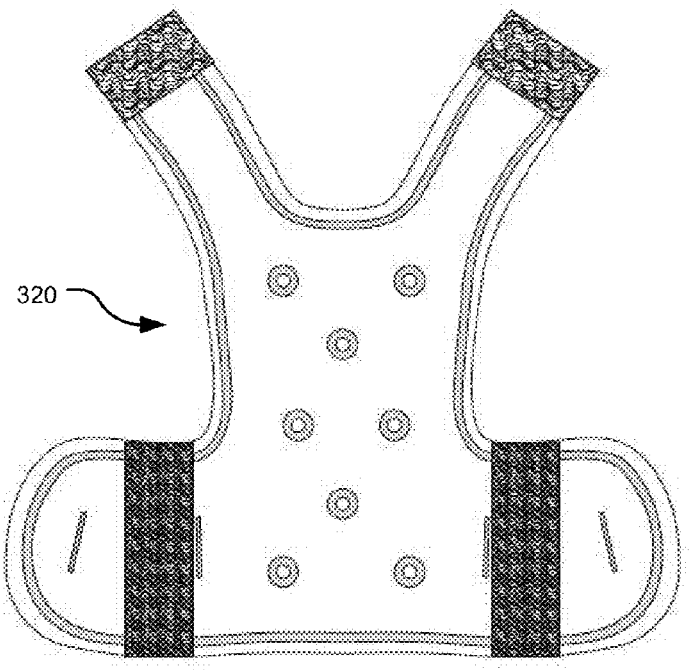
Figure 8A:
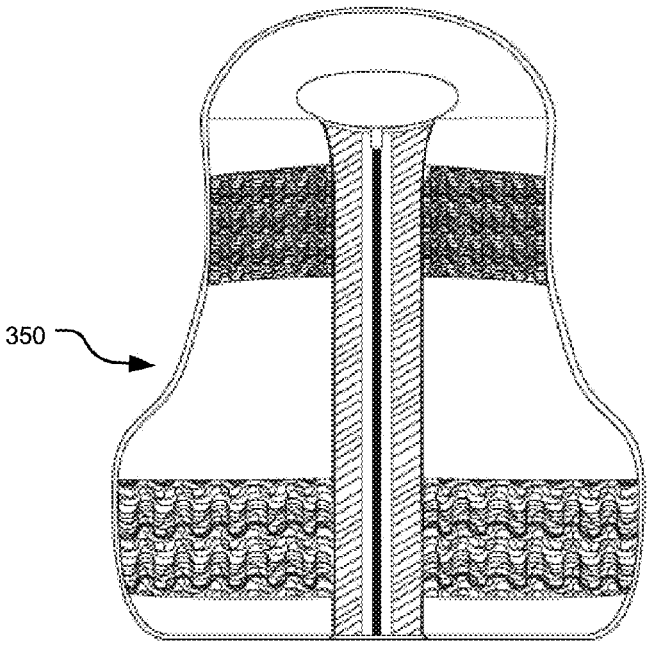
Figure 8B:
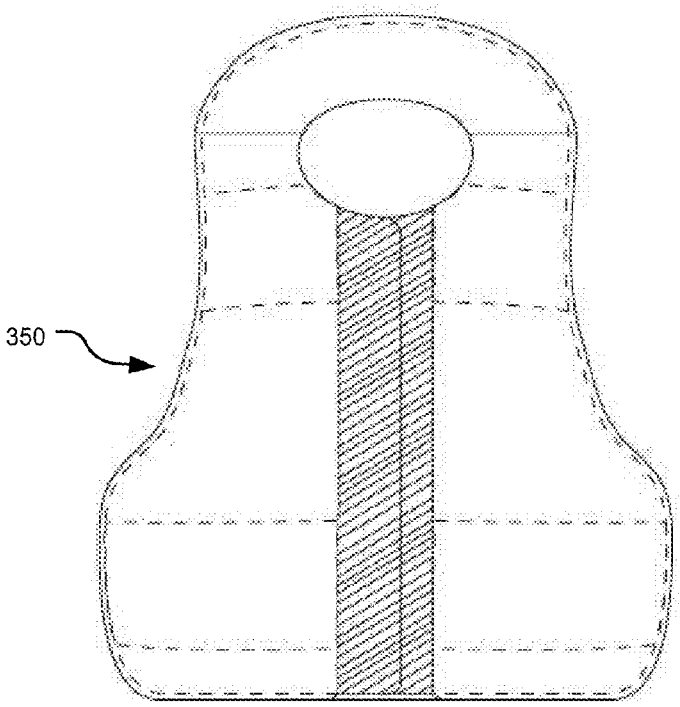

As shown in FIGS. 6A to 6C, shell component 250 has the shape of a vest without a hood. Shell component 250 has hook-and-loop fasteners 256A and 256B (collectively 256). The interaction of hook-and-loop fasteners 256 on shell component 250 and hook-and-loop fasteners 242 on inflatable component 220 enable shell component 250 and inflatable component 220 to be assembled into a wearable assembly. When shell component 250 and inflatable component 220 are assembled, inlet port 226 and outlet port 227 are located under flaps 288 (FIG. 6C) of shell component 250. Flaps 288 are actually "fake" pockets and provide easy access to inlet port 226 and outlet port 227 to inflate or deflate inflatable component 220.

Similar to the embodiment in FIGS. 2A and 2B, shell component 250 has stretchable strips 254 which are expandable and serve as a safety feature. The inner side of shell component 250 may comprise one or more shoulder pockets 290 and one or more waist pockets 292. Shoulder portions 238 and waist portions 240 of inflatable component 220 may extend into shoulder pockets 290 and waist pockets 292.

FIGS. 7A to 10C show a deep pressure therapy system 300 according to another example embodiment of the invention. Comparison of the embodiment of FIGS. 7A to 10C and the embodiment of FIGS. 1A to 3D will reveal that system 100 and system 300 share many common features. Components which are common to systems 100 and 300 bear the same reference numerals (except that the leading number "1" is replaced by the leading number "3") and need not be described further. It should be noted that system 300 may comprise the pump and gauge combination 160 shown in FIGS. 4A and 4B. Alternatively, system 300 may comprise other type of suitable pump and/or gauge.

Figure 9A:
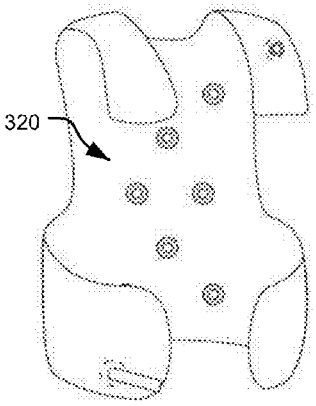
Figure 9B:
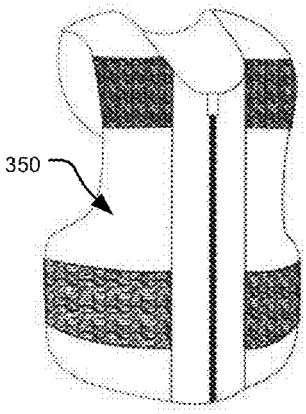
Figure 9C:
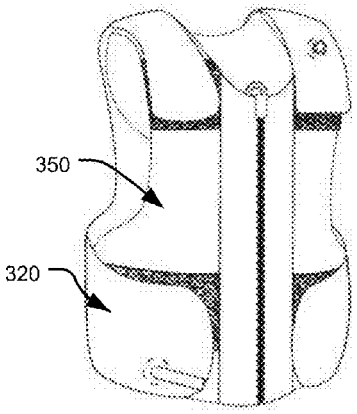
Figure 9D:
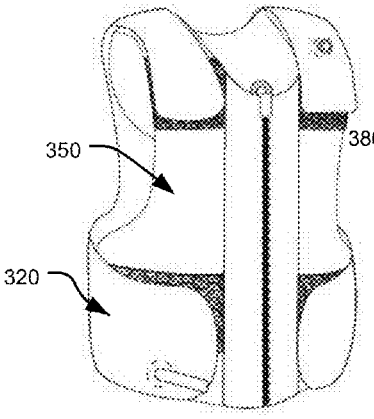
Figure 9E:
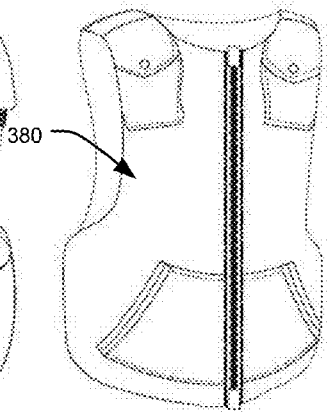
Figure 9F:
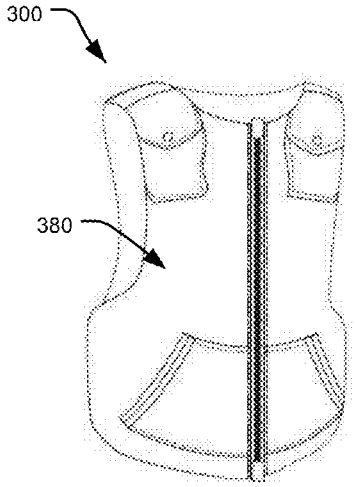
Figure 10A:
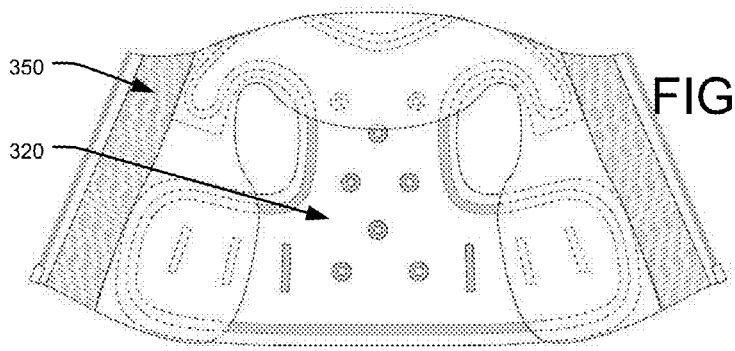
Figure 10B:
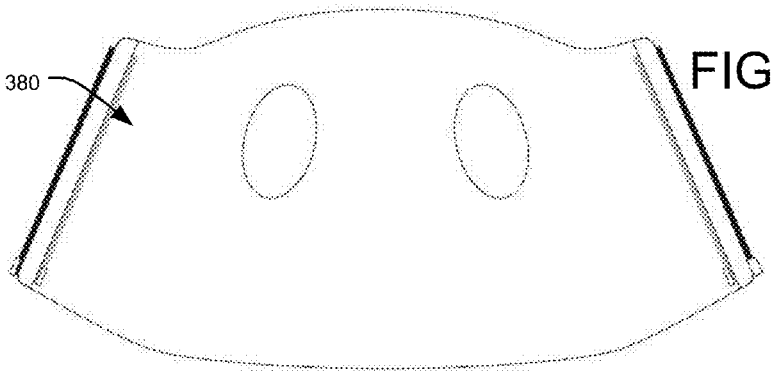
Figure 10C:
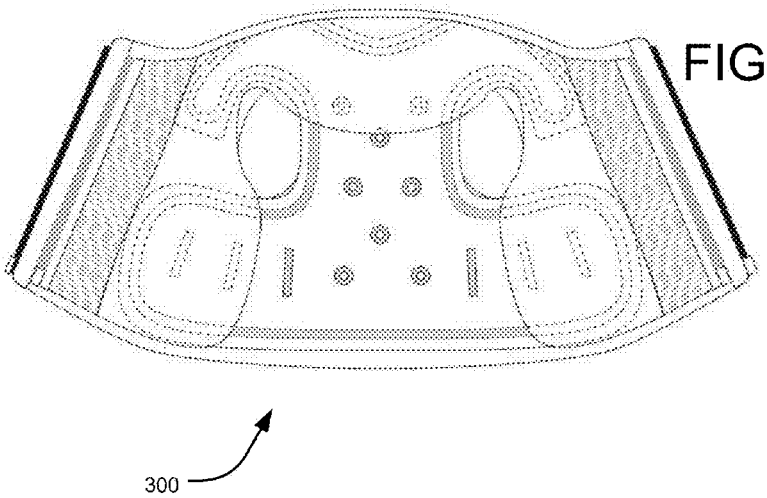

It can be seen that deep pressure therapy system 300 comprises an inflatable component 320 (FIGS. 7A, 7B), an inner shell component 350 (FIGS. 8A, 8B), and an exterior component 380 (FIGS. 9E, 10B). These three components can form a three-piece wearable assembly. FIGS. 9A to 10C schematically show how inflatable component 320, inner shell component 350, and exterior component 380 are assembled together to form a wearable assembly. Exterior component 380 serves at least two functions. One is to protect inflatable component 320 and inner shell component 350 from the environment so that inflatable component 320 and inner shell component 350 do not get dirty as easily. The second is to conceal inflatable component 320 and inner shell component 350 under exterior component 380 to achieve an aesthetic purpose while remaining functional (i.e., 'fake' pockets to access outlet and inlet port for easy inflate and fast deflate for safety, and front zip to quickly get the entire assembly on and off while it stays together so there is no need to re-adjust the entire assembly each time it is worn, unless worn by a different user). In some embodiments, deep pressure therapy system 300 may include multiple exterior components 380 which have different shapes, colors, and/or fabric materials to allow mix-and-match. FIGS. 9A-9C show that inflatable component 320 (FIG. 9A) and inner shell component 350 (FIG. 9B) attach to form a two-piece assembly (FIG. 9C). FIGS. 9D-9F show the two-piece assembly (FIG. 9C) attaches to (e.g., zips into) exterior component 380 to form a three-piece assembly (FIG. 9F).

Figure 11A:
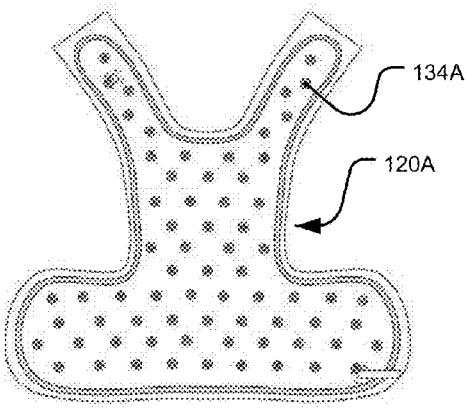
FIGS. 11A to 11E show examples of a variety of welds patterns and/or shapes which may be used on the inflatable component.
Figure 11B:
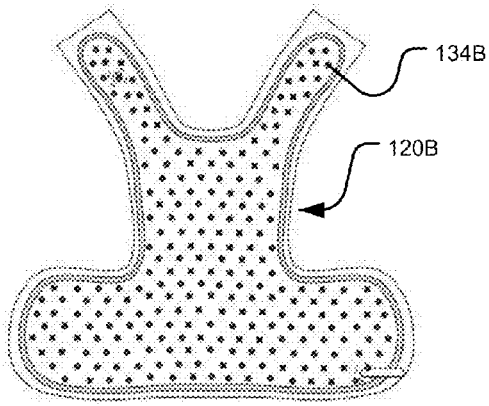
Figure 11C:
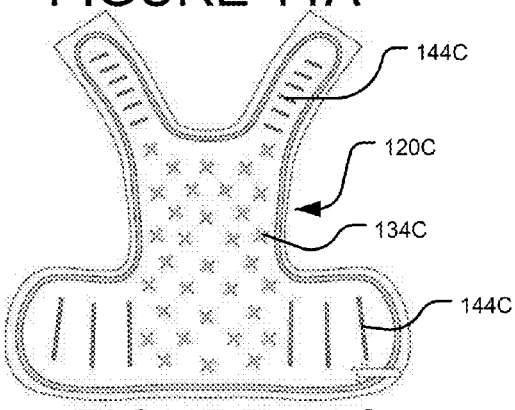
Figure 11D:
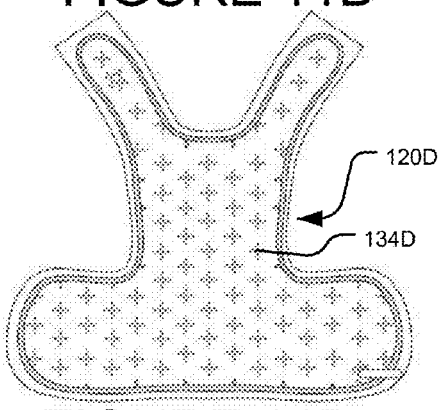
Figure 11E:
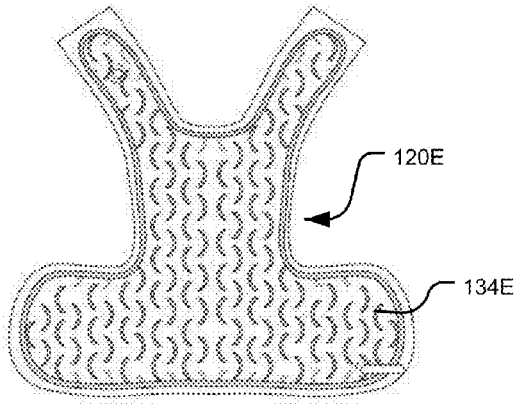

FIGS. 11A to 11E show examples of a variety of welds patterns and/or shapes which may be used on the inflatable component to achieve even distribution of pressure. In FIG. 11A, inflatable component 120A comprises circular welds 134A which are smaller than the circular welds 134 shown in FIG. 1A. It can be seen that circular welds 134A have punched holes. In FIG. 11B, inflatable component 120B comprises even smaller circular welds 134B. In FIG. 11C, inflatable component 120C comprises X-shaped welds 134C as well as welded strips 144C. In FIG. 11D, inflatable component 120D comprises plus-shaped ("+") welds 134D. In FIG. 11E, inflatable component 120E comprises curved welds 134E to create different effects and air flow.

FIG. 12A shows an example inflatable component 120C. FIGS. 12B to 12G show various cross-sectional views of inflatable component 120C taken along lines A-A in FIG. 12A. FIG. 12B is a cross-sectional view of inflatable component 120C when it is deflated. FIG. 12C is a cross-sectional view of inflatable component 120C when it is inflated, wherein the outer side 120O and the inner side 120I of bladder 124 are made of the same material. FIG. 12D is a cross-sectional view of inflatable component 120C when it is inflated, wherein the outer side 120O and the inner side 120I (the side facing the body) of bladder 124 are made of different materials such that the inner side 120I is more stretchable than the outer side 120O, thereby forcing pressure towards the body. FIG. 12E is a cross-sectional view of inflatable component 120C, wherein the outer side 120O and the inner side 120I of the bladder 124 are made of the same material and a fabric layer is on either side of the bladder sewn around the outer edge and the fabric layer 178O on the outer side is non-stretchable and the fabric layer 178I on the inner side facing toward the body is stretchable thereby forcing pressure towards the body (bladder 124 is sandwiched between fabric layers 178O, 178I).

Figure 12I:
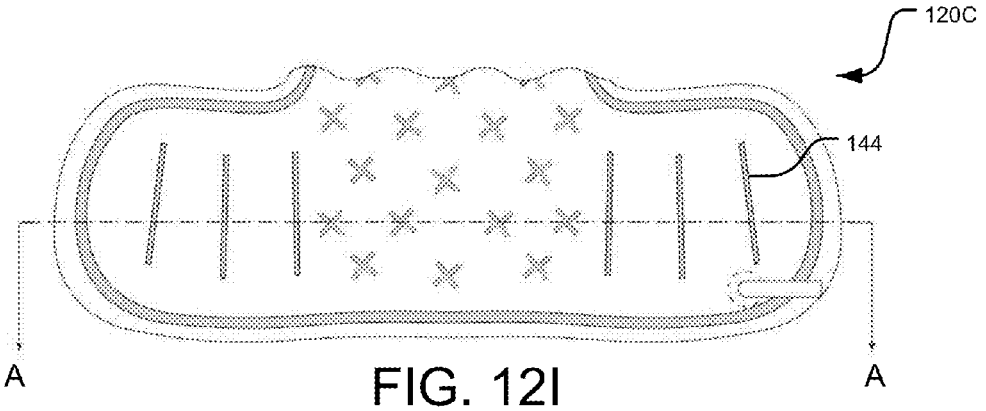
FIG. 12I a portion of an example inflatable component, as also shown in FIG. 12A.
Figure 12J:
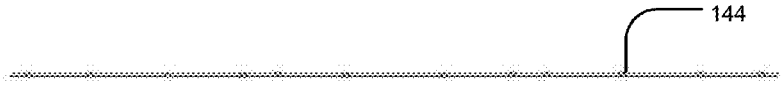
FIG. 12J shows a similar component to that shown in FIG. 12B.
Figure 12K:
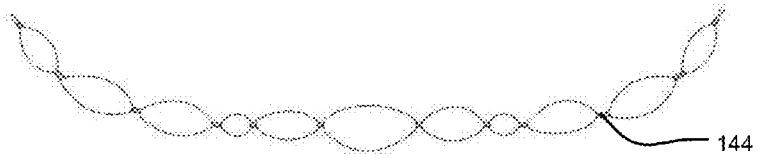
FIGS. 12K to 12L show various possible cross-sectional views of the FIG. 12I inflatable component, wherein the cross-sectional views are in their natural curved shape.
Figure 12L:
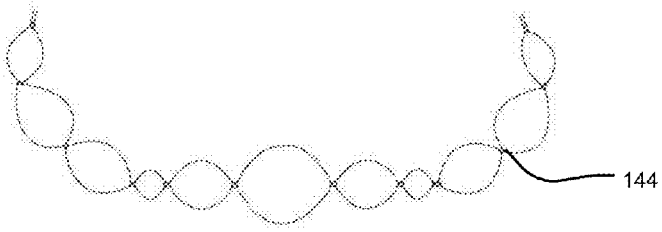

FIG. 12F is a cross-sectional view of inflatable component 120C, wherein the outer side 120O and inner side 120I of bladder 124 are not fully welded together except for around the outer edges and the inner side 120I and outer side 120O of the bladder 124 are made of the same material. The welds 134 are welded extrusions, or three-dimensional welds. Welded strips 144 are also three-dimensional, i.e., have increased thicknesses. The thickness T of welds 134 and/or welded strips 144 may be in the range of 0.1 cm to 3 cm, for example, 0.1 cm to 0.5 cm, 0.5 cm to 1 cm, 1 cm to 1.5 cm, 1.5 cm to 2 cm, 2 cm to 2.5 cm, or 2.5 cm to 3 cm. One of the advantages of using extruded or three-dimensional welds is that localized depressions are closer to the surface of the user's body to create a more even distribution of pressure. A perspective view of a possible X-shaped three dimensional weld 134X is shown in FIG. 12H. FIG. 12G is a cross-sectional view of inflatable component 120C which is similar to the embodiment in FIG. 12F, except that inner side 120I is more stretchable than the outer side 120O. For illustrative purposes, the cross-sectional views in FIGS. 12C to 12G are intentionally straightened. FIGS. 12K and 12L show a more accurate depiction of how the bladder will look like when it is partially inflated (FIG. 12K) or fully inflated (FIG. 12L). Because of welded strips 144, bladder 124 will naturally tend to wrap around the body of the wearer when inflated. The shape and placement of welded strips 144 can also dictate the form of the bladder when inflated.

Figure 13F:
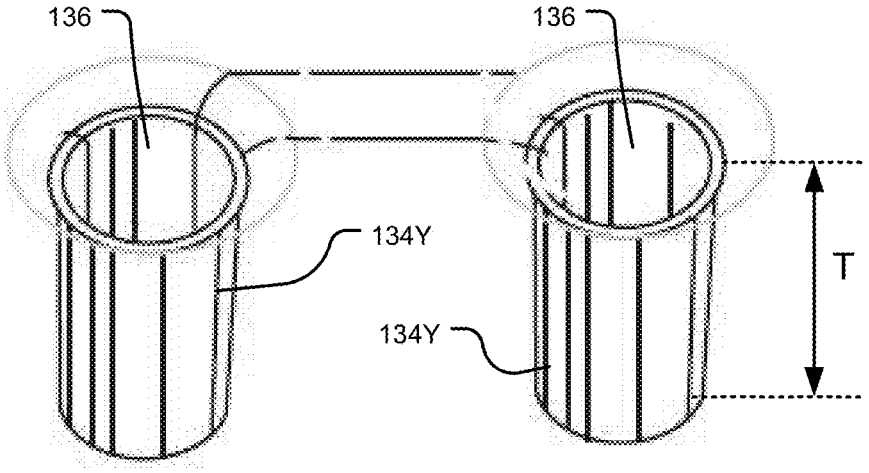
FIG. 13F shows a possible three-dimensional weld that may be used in the FIG. 13A inflatable component.

FIG. 13A shows an example inflatable component 120A. FIGS. 13B to 13E show various alternative cross-sectional views of inflatable component 120A taken along lines B-B (passing through punched holes 136) in FIG. 13A. FIG. 13B is a cross-sectional view of inflatable component 120A when it is deflated. FIG. 13C is a cross-sectional view of inflatable component 120A when it is inflated, wherein the outer side 120O and the inner side 120I of bladder 124 are made of the same material. FIG. 13D is a cross-sectional view of inflatable component 120A when it is inflated, wherein the outer side 120O and the inner side 120I of bladder 124 are made of different materials such that the inner side 120I is more stretchable than the outer side 120O, thereby forcing pressure towards the body. FIG. 13E is a cross-sectional view of inflatable component 120A, wherein the outer side 120O and inner side 120I of bladder 124 are not fully welded together except for around the edges. In FIG. 13E, the welds are three-dimensional welds 134Y. The FIG. 13E three-dimensional weld 134Y comprises a hollow tube which extends from the outer side 120O to the inner side 120I of bladder 124. The thickness T of weld 134Y may be in the range of 0.1 cm to 3 cm, for example, 0.1 cm to 0.5 cm, 0.5 cm to 1 cm, 1 cm to 1.5 cm, 1.5 cm to 2 cm, 2 cm to 2.5 cm, or 2.5 cm to 3 cm. As described earlier, one of the advantages of using extruded or three-dimensional welds is that localized depressions are closer to the surface of the user's body to create a more even distribution of pressure. An enlarged and perspective view of three-dimensional welds 134Y is shown in FIG. 13F.

FIG. 14A shows an example inflatable component 120F. FIGS. 14B to 14D show various alternative cross-sectional views of inflatable component 120F taken along lines C-C in FIG. 14A. FIG. 14B is a cross-sectional view of inflatable component 120F when it is deflated. FIG. 14C is a cross-sectional view of inflatable component 120F when it is inflated, wherein the outer side 120O and the inner side 120I of bladder 124 are made of the same material. The area where more welds are located closer together, the inflatable component expands less and the area where welds are placed farther apart allows the inflatable component to expand further to give more pressure. By placing the welds in different areas or closer or farther apart, pressure can be distributed more or less in different areas. FIG. 14D is a cross-sectional view of inflatable component 120F when it is inflated, wherein the outer side 120O and the inner side 120I of bladder 124 are made of different materials such that the inner side is more stretchable than the outer side, thereby forcing pressure towards the body.

Figure 15:
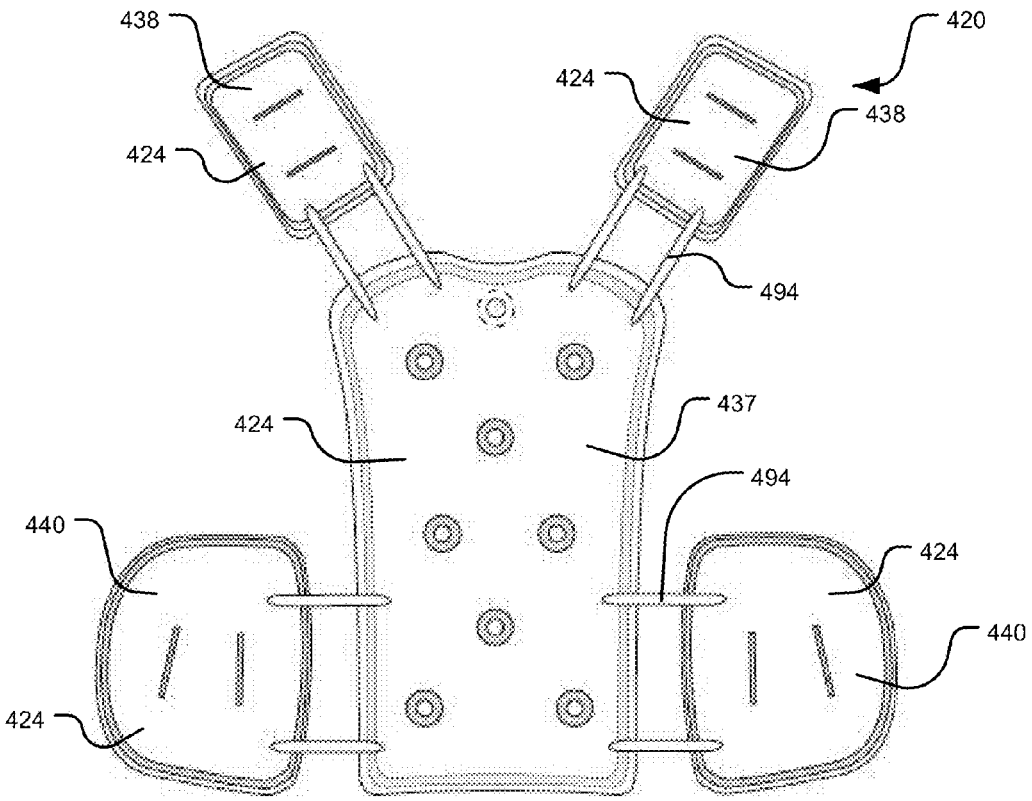
FIG. 15 shows an inflatable component according to another embodiment.

FIG. 15 shows an inflatable component 420 according to an alternative embodiment. Inflatable component 420 comprises a central portion 437, two separate shoulder portions 438, and two separate waist portions 440. Each one of these portions comprises a bladder 424. In FIG. 15, inflatable component 420 comprises a total of five bladders 424. In other embodiments, the inflatable component could have more or less than five bladders. The bladders 424 are connected by connecting tubes 494 which permit fluid (e.g., air) to flow from one bladder to the next. Because connecting tubes 494 are flexible and can be brought closer to each other, inflatable component 420 is adjustable in length and width, and in a much different way than in the previous embodiments.

Figure 16:
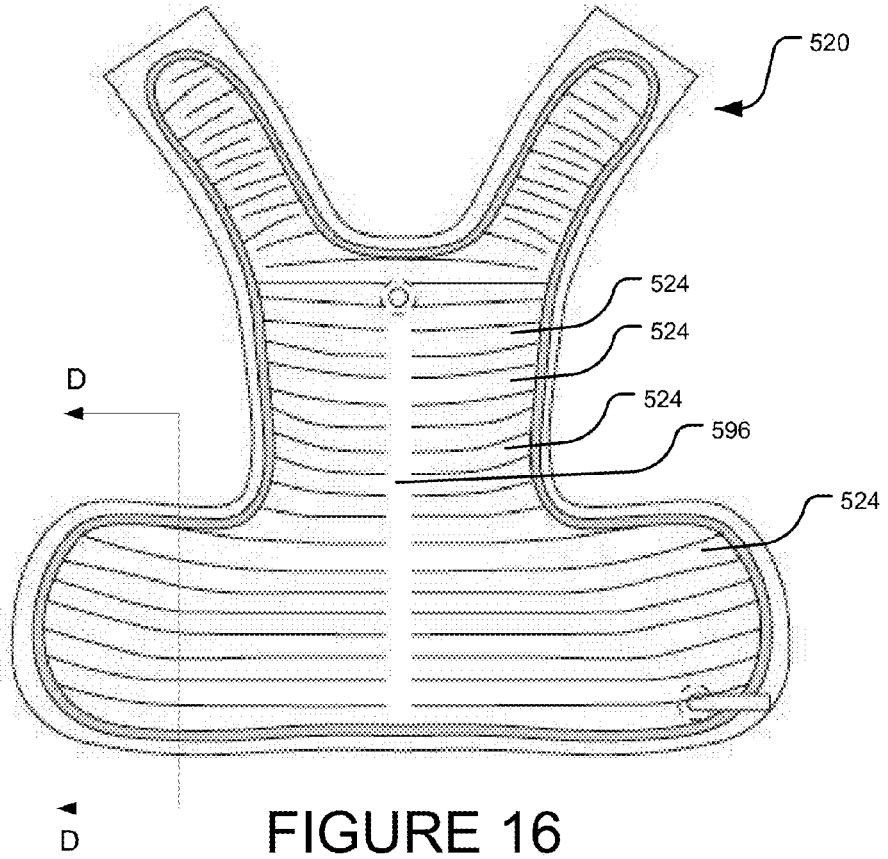
FIG. 16 shows an inflatable component according to another embodiment.
Figure 16A:
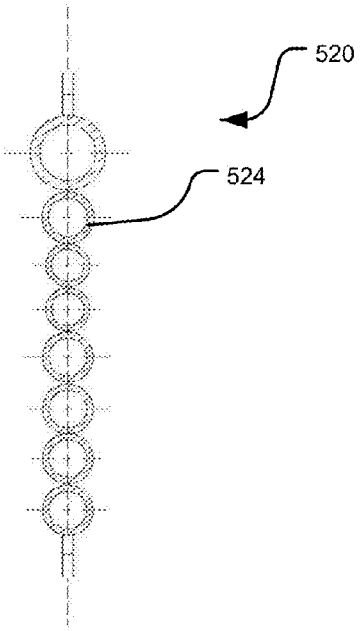
FIG. 16A shows a cross-sectional view of the FIG. 16 inflatable component.

FIG. 16 shows an inflatable component 520 according to an alternative embodiment. Instead of a single chamber bladder, inflatable component 520 comprises a plurality of inflatable tubes 524 which are joined together in a side-by-side fashion. Inflatable tubes 524 are welded together at their longitudinal ends around the edges of inflatable component 520. Inflatable tubes 524 are connected through the centre with a central canal 596 which allow fluid (e.g., air) to flow into and/or between each of inflatable tubes 524. FIG. 16A shows an example cross-section of a number of inflatable hollow tubes 524 taken along lines D-D in FIG. 16.

The various deep pressure therapy systems described in the foregoing has many advantages. They tend to give overall evenly-distributed pressure to the sides, back and shoulders of the torso. Varying the weld location and weld shapes can place more or less pressure in various areas of the torso. Welds can also assist in taking the shape of the torso to 'wrap' around the user's body when inflated, creating a better 'hug' and reducing pressure off of the stomach and chest. Welds also prevent the bladder from 'ballooning'-out, and punched holes in the welds provide breathability. Combining stretch with non-stretch materials can help the vest expand inwards towards the body. They are provided with a number of safety features. For example, no inflatable pressure is directly applied on the stomach and chest regions of the body. The stretchable strips can reduce pressure exerted on certain parts of the body when the bladder is inflated. The pressure relief valve in the inlet port or a separate flange prevents the bladder from being over-inflated, although the threshold value of the pressure relief valve may be adjustable to suit the individual needs of different users. The outlet port is located in easy-to-access locations and can be easily and quickly accessed to release pressure from the bladder. The use of front zippers allows the system to be quickly and easily taken on or off, as well as the inflatable component may be ripped off quickly with hook and loop fasteners. The bladder is its own support structure and attaches to a shell which acts to conceal the technology and also allow the product to adjust easily in length and width to fit different sizes.

In some embodiments, the pump and gauge and other control mechanisms are located off the wearable assembly. Therefore, the body is not directly exposed to electronic components or batteries, which adds to the safety of the system. This would also reduce the overall weight and bulk of the wearable assembly and make the system more portable. Also, the method for inflating the bladder is simple and straightforward; even a child can operate the pump to inflate the bladder, thereby giving the user greater independence and confidence. If the user chooses pressure settings to 'vary' the pressure, this can avoid habituation and the pump system can then be attached to the wearable assembly. A vibration setting may also be available. Varying the pressure will allow the effects of the deep pressure therapy to last longer.

Another advantage is that the wearable assembly when viewed from the outside looks very much like a regular garment. For individuals who are fashion-conscious, the wearable assembly does not create any disincentives as it can be made to resemble regular clothing. This is especially important for children who do not want to be seen by their peers as wearing an awkward "device". Additionally, because the assembly comprises components that can be easily separated, it is easy to wash them. Shell components are machine washable. The device is highly adjustable and can last a growing child many years, or may be used on multiple children of different sizes.

Figure 17A:
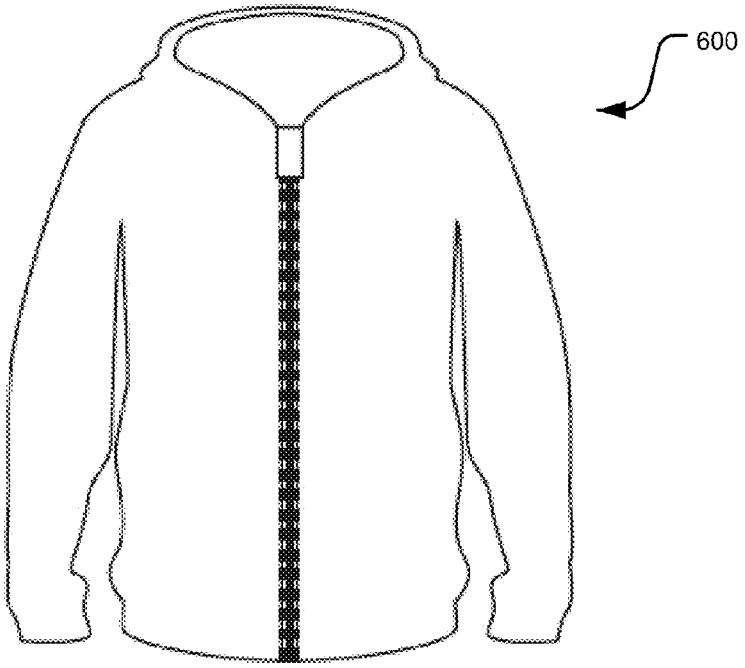
FIGS. 17A and 17B show an alternative deep pressure therapy system in the form of a wearable jacket with two long sleeves.
Figure 17B:
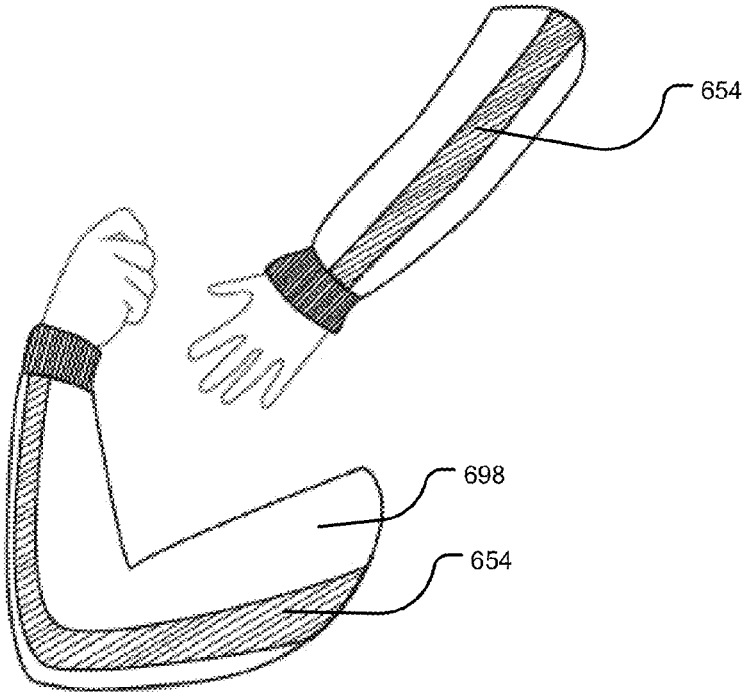

As mentioned earlier, the present invention may take the form of other types of wearable garment, and may apply pressure to other parts of the body (not just the torso). FIGS. 17A and 17B show an embodiment of deep pressure therapy system 600 which takes the form of a jacket having two long sleeves, which may apply pressure to both the torso and the arms. In the FIGS. 17A and 17B embodiment, the sleeve comprises an inflatable portion 698. Inflatable portion 698 may be continuous or separate from torso bladder (hidden from view in FIG. 17A). One or more elastic strips 654 runs the entire length of the arm so that pressure on the arm does not get too tight as to cut off blood circulation. Any type of welds, bladders, or configurations shown in the torso examples may be transferrable to the arms or any other body part.

Figure 18:
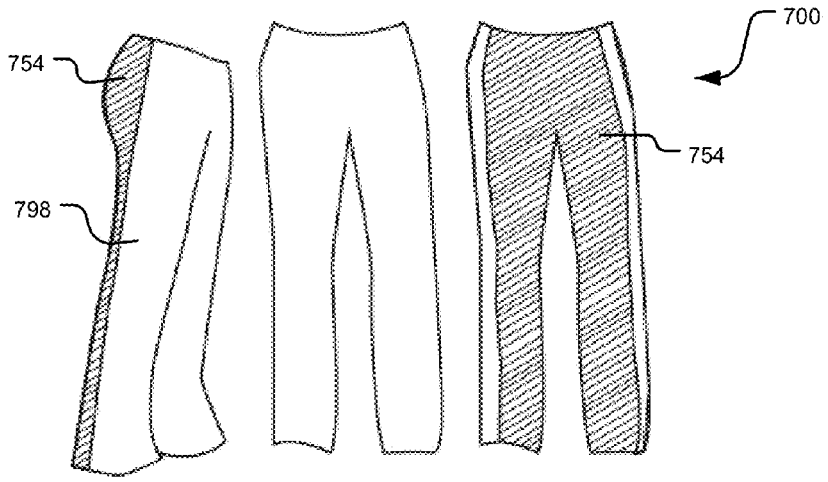
FIG. 18 shows an alternative deep pressure therapy system in the form of wearable pants.

FIG. 18 shows an embodiment of a deep pressure therapy system 700 which take the form of a pair of pants. The pants comprise inflatable portion(s) 798. One or more elastic strips 754 runs the length of the leg so that pressure on the leg does not get too tight as to cut off blood circulation. Additionally, the elastic strips 754 may accommodate comfortable sitting. Pants may have a separate outlet and inlet valve of the torso and may take any bladder, weld, material, etc transferrable from the torso examples. Pressure to the legs may also help individuals with restless legs syndrome.

Figure 19A:
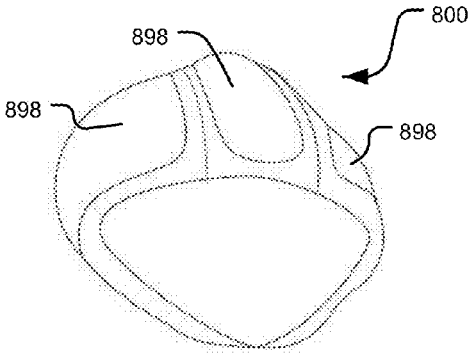
FIGS. 19A to 19B show an alternative deep pressure therapy system in the form of a wearable hood.
Figure 19C:
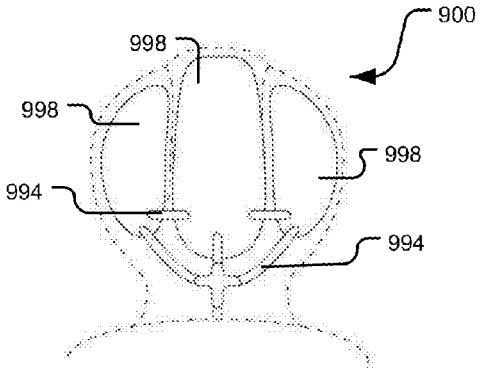
FIG. 19C shows an alternative deep pressure therapy system in the form of a wearable hood.
Figure 19B:
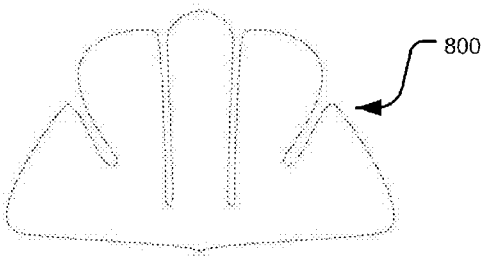

FIGS. 19A to 19B show an embodiment of deep pressure therapy system 800 which take the form of hood, which may apply pressure to the head. In the FIGS. 19A and 19B embodiment, the hood comprises one inflatable bladder having a single zone chamber. FIGS. 19A and 19B show the same embodiment. In FIG. 19B, the embodiment is laying flat. In FIG. 19A, the embodiment is wrapped around the head and comprises inflatable portions 898. Head bladder may attach directly to torso bladder by one continuous bladder or may be attachable/detachable to torso through a connector tube (similar to tube 494 in FIG. 15) or may be completely separate from torso bladder therefore may inflate/deflate with torso bladder or inflate/deflate separate. FIG. 19C is a multiple bladder embodiment 900 which may apply pressure to the head. Separate inflatable portions 998 may be connected with connecting tubes 994. The hood may be inflated or deflated on its own or along with the bladder for the torso. Bladders in FIG. 19C or bladder sections in FIGS. 19A and 19B can be wrapped around the head and secured into hood pockets with hook or loop or other fasteners and concealed within a fabric shell to create a wearable assembly.

The above detailed description of example embodiments of the invention are not intended to be exhaustive or to limit the invention to the precise form disclosed above. While specific embodiments of the invention are described for illustrative purposes, various modifications are possible, as those skilled in the relevant art would recognize.

Various elements of the invention may be used alone, in combination, or in a variety of arrangements not specifically discussed in the embodiments described in the foregoing. For example, elements described in one embodiment may be combined with elements described in other embodiments.

The scope of the claims should not be limited by the embodiments set forth in the examples, but should be given the broadest interpretation consistent with the description as a whole.

What is claimed is:

1. A deep pressure therapy system that uses pressure to produce a therapeutic calming effect on a person with a medical condition, comprising:

an inflatable component and a shell component;

wherein the inflatable component is removably attachable to the shell component to form a wearable assembly;

wherein the inflatable component is shaped to conform to a portion of a body of a person;

wherein the inflatable component comprises an inflatable bladder;

the bladder comprising a plurality of depressions and a plurality of weld strips, wherein the weld strips are configured to allow the bladder to conform to a portion of the body of the person when the bladder is inflated, and wherein the inflatable component comprises a central portion for covering the person's torso, two shoulder portions for covering the person's shoulders and two waist portions for covering the person's waist, such that pressure is applied to the back, sides, and shoulder regions of the person's torso, but not directly on the stomach or chest of the person.

2. A deep pressure therapy system according to claim 1, wherein the plurality of depressions are generally evenly-distributed over a portion of the bladder.

3. A deep pressure therapy system according to claim 1, wherein the plurality of depressions are generally evenly-distributed over a substantial portion of the bladder.

4. A deep pressure therapy system according to claim 1, wherein the depressions are created by welding.

5. A deep pressure therapy system according to claim 1, wherein the depressions comprise circular welds.

6. A deep pressure therapy system according to claim 1, wherein the depressions comprise extruded three-dimensional welds.

7. A deep pressure therapy system according to claim 1, wherein the depressions comprise holes.

8. A deep pressure therapy system according to claim 1, wherein the depressions permit the inflatable component to exert generally evenly-distributed pressure to said portion of the body.

9. A deep pressure therapy system according to claim 1, wherein both the inflatable component and the shell component comprise hook-and-loop fasteners which allow the inflatable component and the shell component to be removably assembled together.

10. A deep pressure therapy system according to claim 9, wherein the assembly of the inflatable component and the shell component via the hook-and-loop fasteners allow the wearable assembly to be adjustable in length and/or width.

11. A deep pressure therapy system according to claim 1, wherein the bladder has an inner side for facing the body and an outer side for facing away from the body, and the inner side is more stretchable than the outer side.

12. A deep pressure therapy system according to claim 1, wherein the bladder comprises a single chamber.

13. A deep pressure therapy system according to claim 1, wherein the bladder comprises multiple chambers which are connected.

14. A deep pressure therapy system according to claim 1, wherein the bladder comprises multiple chambers which are separated.

15. A deep pressure therapy system according to claim 1, wherein the inflatable component has an inner side for facing the body and comprises a fabric mesh on the inner side of the inflatable component.

16. A deep pressure therapy system according to claim 1, wherein the shell component comprises one or more stretchable strips which are expandable when the shell component is assembled with the inflatable component and the inflatable component is inflated.

17. A deep pressure therapy system according to claim 1, further comprising an exterior component such that when the inflatable component, the shell component and the exterior component are assembled into a wearable assembly, the exterior component conceals the inflatable component and the shell component from view.

18. A deep pressure therapy system according to claim 1, further comprising a pump for inflating the bladder.

19. A deep pressure therapy system according to claim 1, wherein the weld strips are located and shaped to exert different amounts of pressure on various areas of the person's torso.

* * * * *